US011208283B2

(12) United States Patent
Sehlleier et al.

(10) Patent No.: US 11,208,283 B2
(45) Date of Patent: Dec. 28, 2021

(54) RECEIVING MEANS FOR RECEIVING FILM MATERIAL

(71) Applicant: WINDMÖLLER & HÖLSCHER KG, Lengerich (DE)

(72) Inventors: Thomas Sehlleier, Coesfeld-Lette (DE); Frank Hoffmann, Greven (DE)

(73) Assignee: WINDMÖLLER & HÖLSCHER KG, Lengerich (DE)

( * ) Notice: Subject to any disclaimer, the term of this patent is extended or adjusted under 35 U.S.C. 154(b) by 0 days.

(21) Appl. No.: 15/755,494

(22) PCT Filed: Jun. 6, 2016

(86) PCT No.: PCT/EP2016/062808
§ 371 (c)(1),
(2) Date: Mar. 6, 2018

(87) PCT Pub. No.: WO2017/036620
PCT Pub. Date: Mar. 9, 2017

(65) Prior Publication Data

US 2018/0257891 A1 Sep. 13, 2018

(30) Foreign Application Priority Data

Aug. 28, 2015 (DE) ..... 10 2015 114 391.7

(51) Int. Cl.
*B65H 19/28* (2006.01)
*B65H 75/10* (2006.01)
(Continued)

(52) U.S. Cl.
CPC ..... *B65H 19/283* (2013.01); *B65H 19/30* (2013.01); *B65H 75/10* (2013.01); *B65H 75/28* (2013.01);
(Continued)

(58) Field of Classification Search
CPC .... B65H 19/383; B65H 19/386; B65H 19/30; B65H 75/10; B65H 75/28;
(Continued)

(56) References Cited

U.S. PATENT DOCUMENTS 4,385,960 A 5/1983 Zodrow et al.
4,422,586 A 12/1983 Tetro
(Continued)

FOREIGN PATENT DOCUMENTS

CN 101501156 A 8/2009
CN 102164836 A 8/2011
(Continued)

OTHER PUBLICATIONS

PCT International Search Report (with English translation) & Written Opinion, International Application No. PCT/EP2016/062808, dated Sep. 1, 2016, 15 Pages.
(Continued)

*Primary Examiner* — George R Koch
(74) *Attorney, Agent, or Firm* — Fenwick & West LLP

(57) ABSTRACT

The invention relates to a receiving means (200) for receiving film material (250) for use in a winding machine (IO), wherein the receiving means (200) comprises at least one bearing region (210) for attaching the receiving means (200) to a winding unit (20) of the winding machine (IO) and comprises a wall (220) having an outer surface region (230), wherein the wall (220) is designed in such a way that the surface region (230) can be placed onto a transport device (30) of the winding machine (10) and the film material (250) can be received onto the surface region (230).

36 Claims, 6 Drawing Sheets

Figure 2:
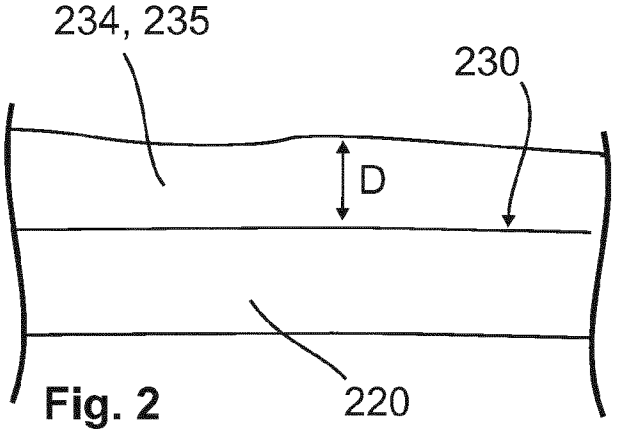

(51) Int. Cl.
*B65H 75/28* (2006.01)
*B65H 19/30* (2006.01)

(52) U.S. Cl.
CPC ..... *B65H 2301/41424* (2013.01); *B65H 2408/236* (2013.01); *B65H 2701/1752* (2013.01)

(58) Field of Classification Search
CPC .... B65H 2301/41424; B65H 2408/236; B65H 2701/1752
See application file for complete search history.

(56) References Cited

U.S. PATENT DOCUMENTS

| | | | | |
|---|---|---|---|---|
| 4,993,652 | A | 2/1991 | Moeller | |
| 2005/0077414 | A1* | 4/2005 | Wohflahrt | B65H 19/262 242/526.2 |
| 2007/0246595 | A1* | 10/2007 | Tsai | B65H 19/2269 242/532.3 |
| 2009/0324868 | A1* | 12/2009 | Tamai | B65H 19/283 428/41.6 |
| 2013/0099924 | A1* | 4/2013 | Larsson | G08B 21/182 340/540 |
| 2016/0107858 | A1* | 4/2016 | Cheng | B65H 75/10 242/160.4 |
| 2016/0107860 | A1* | 4/2016 | Jendroska | B65H 19/305 242/532.3 |

FOREIGN PATENT DOCUMENTS

| | | | |
|---|---|---|---|
| DE | 32 25 518 | A1 | 3/1983 |
| DE | 10 2004 050 255 | A1 | 4/2006 |
| DE | 10 2013 108 830 | A1 | 5/2006 |
| DE | 10 2004 000 037 | A1 | 11/2014 |
| DE | 102013108829 | A1 | 11/2014 |
| EP | 0385082 | A2 | 9/1990 |
| EP | 0931744 | A2 | 7/1999 |
| EP | 1306332 | A2 | 5/2003 |
| JP | H07-206234 | A | 8/1995 |

OTHER PUBLICATIONS

German Office Action, German Application No. 10 2015 114 391.7, dated Apr. 12, 2016, 7 pages (with English summary).
PCT International Search Report, PCT Application No. PCT/EP2016/062808, dated Sep. 1, 2016, 15 pages (with English summary).
China National Intellectual Property Administration, Notification of the First Office Action, CN Patent Application No. 201680049339.8, dated Apr. 18, 2019, 29 pages.
China National Intellectual Property Administration, Notification of the Second Office Action, CN Patent Application No. 201680049339.8, dated Jan. 15, 2020, 26 pages.
China National Intellectual Property Administration, Office Action, CN Patent Application No. 201680049339.8, dated Jan. 21, 2021, 26 pages.
European Patent Office, Office Action, EP Patent Application No. 16728285.4, dated Oct. 20, 2020, nine pages (with English summary).

* cited by examiner

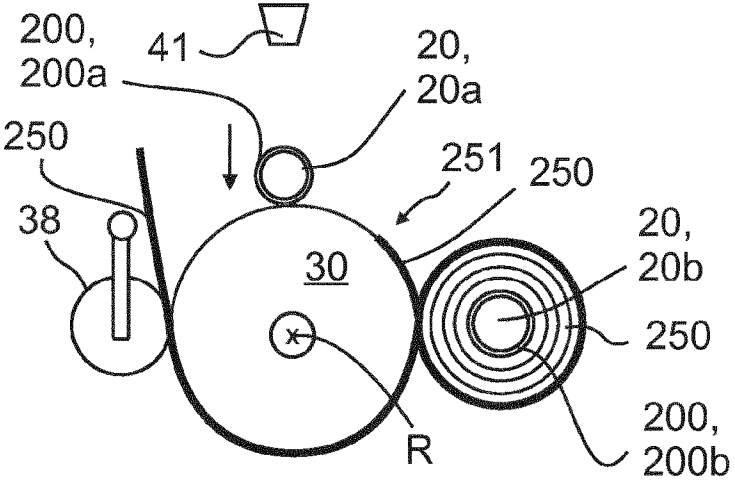
Fig. 12
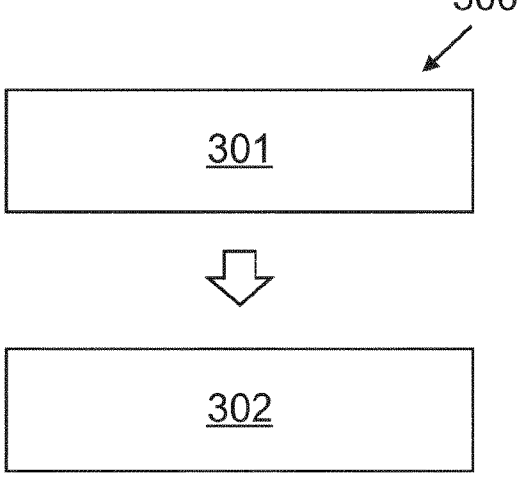
Fig. 13
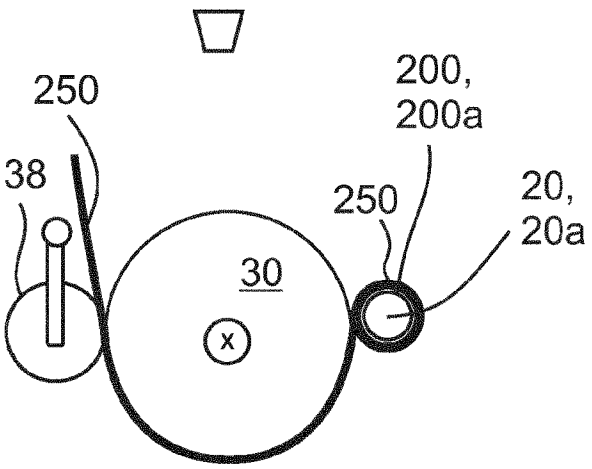
Fig. 14
Fig. 15

RECEIVING MEANS FOR RECEIVING FILM MATERIAL

This application is a 371 of PCT/EP2016/062808, filing date Jun. 6, 2016.

The invention relates to a receiving means for receiving film material for the use in a winding machine according to the preamble of claim 1. Further, the invention relates to a method for the performance of an automatized change of rollers for a winding machine, a device for the performance of an automatized change of rollers and a film production device.

In the production of films, films are produced as endless material and are wound up on receiving means (for example sleeves) in winding machines. After the desired film length was wound up to a receiving means, a change of rollers is performed. To do this, the film has to be separated and wound up to a new receiving means.

It is well known from the state of the art to prepare the receiving means with a glue and subsequently placing it on a film web that is lifted off the contact roller. A direct application of the receiving means to the contact roller is thereby avoided, since due to the adhesion of the surface of the receiving means at the contact roller surface parts of the receiving means are tearing and contaminating the contact roller.

It is a disadvantage with the known solutions regarding a change of rollers that the lifting of the film path from the contact roller is more time-consuming and more complex to implement. Further, often no turning-free initial winding up of the film is possible at the receiving means. Due to the adhesion of the receiving means at the film often a rupture of the film path occurs. With a direct application of the receiving means to the contact roller (without previously lifting the film path) parts of the receiving means are detached due to the adhesion caused by the adhesive and contaminate the contact roller. Further, a manual gluing of the receiving means is necessary which represents an elaborate operating step and is therewith connected to high costs and loss in speed.

It is therefore the object of the present invention to at least partially avoid the previously described disadvantages. Particularly, it is the object of the present invention to enable a reliable fast and/or cost-efficient change of rollers for a winding machine. Further, it is particularly an object to provide a receiving means which enables an envelope-free winding up, wherein a contamination of the contact roller should be avoided.

The previous object is solved by a receiving means for receiving film material with the features of the independent claim 1 and by a method with the features of the independent claim 4 and by a device with the features of the independent claim 23 and by a film production device with the features of the independent claim 36. Further features and details of the invention result from the respective dependent claims, the description and the drawings. Thereby features and details which are described in connection with the device according to the invention naturally also occur in relation to the method according to the invention, the receiving means according to the invention and the film production device according to the invention and vice versa, such that it can always be reciprocally related to according to the disclosure of the single aspects of the invention.

According to the invention a receiving means for receiving film material for the use in a winding machine is provided, wherein particularly the receiving means comprises at least a bearing region for the mounting of the receiving means at the winding unit of the winding machine and a wall with an outer surface region. The wall is preferably configured such that the surface region is applicable to a transport device of the winding machine and the film material is receivable on the surface region. Particularly, the receiving means preferably the surface region is wrappable by a film material on the outside. The film material is therefore, for example, transported from a transport device of the winding machine particularly in form of a film path and/or an endless material. As soon as a film beginning of the film material arrives at a contact position (receiving position) of the receiving means with the transport device the film beginning can adhere to the receiving means and is taken along with the receiving means and is therewith wrapped to the receiving means particularly envelope-free. Hereby, it is preferably provided that the surface region of the receiving means comprises at least partially an outer adhesive means layer for contacting the film material in order to particularly enable an adhesion of the film material to the receiving means for initial winding up (and thus also to the acceptance or winding up). The adhesive means layer preferably comprises an average thickness of maximum 2000 μm in order to mainly maintain the structure of the surface region during placing and/or after placing to the transport device. Hereby, it is prevented that during placing of the receiving means to the transport device parts of the receiving means detach due to adhesion of the adhesive means of the adhesive means layer at the transport device and therewith contaminate the transport device.

The receiving means can, for example, be configured as a sleeve for the winding machine, particularly a paper sleeve. During placing of the receiving means on the transport device the structure of the surface region of the wall can be affected for example by the fact that parts of the receiving means like the outer paper layers (paper sheets) are at least partially detached. Due to the reduction of the average thickness of the adhesive means layer, however, the adhesion can be reduced particularly a stickiness or adhesive strength such that the structure of the surface region is mainly maintained and/or during application no affecting contamination of the surface of the transport device occurs, particularly of a contact roller. A further advantage for the change of rollers results particularly by the fact that the receiving means can be automatized prepared with an adhesive means for the configuration of the outer adhesive means layer. The adhesive means layer thereby preferably comprises all adhesive means regions at the surface region and/or at the receiving means. The remaining regions or areas of the surface region outside the adhesive means layer are preferably free from adhesive means and/or contact-free. Contact-free means that these areas only contact the surrounding (surrounding air) towards the outside (and therewith not the adhesive means layer) and accordingly configure the outer layer or surface of the receiving means. This surface or outer layer is particularly configured by the outer area (outside) of the wall wherein preferably the inner side of the wall configures the bearing region. The wall, particularly outer wall and/or the surface region, preferably comprises paper and/or tissue and/or partly also plastic and/or metal. Hereto, an adhesive means, particularly a hot-melt-adhesive, is applied for the configuration of the adhesive means layer, for example, by an application device of the winding machine. Thus, the advantage is achieved that the adhesive means layer can be applied particularly thin and automatized. Therewith, the receiving means according to the invention is suitable for the direct contact to the transport device which is, for example, configured as a contact roller.

The adhesive means and/or the adhesive means layer with the adhesive means can preferably comprise a melt adhesive which is for example applicable to the receiving means by spray application. The adhesive means can further, for example, comprise a viscosity of mainly 4400 MPas (Millipascalsecond) (at 150° C. degrees Celsius) and/or of mainly 1500 MPas (at mainly 175° C. degrees Celsius) and/or a density of mainly 0.97 g/cm$^3$ (at 23° C.). The adhesive means can be suitable for a processing temperature which is in the area of 100° C. to 250° C., particularly 140° C. to 170° C. Therewith an adhesive means layer can be generated which comprises such a small stickiness that during application of the receiving means with the adhesive means layer to the surface of the transport device no essential detachment of parts of the receiving means occurs.

In a measure improving the invention the average thickness of the adhesive means layer can amount to maximum 1000 μm or maximum 700 μm or maximum 300 μm and/or be in the area of 5 μm to 300 μm, preferably 100 μm to 200 μm, wherein particularly the inner side of the adhesive means layer contacts the wall and the outer side of the adhesive means layer and/or the surface regions are configured contact-free without adhesive means layer. The adhesive means layer is preferably configured in that an adhesive means is applied particularly sprayed to the surface of the receiving means (meaning the surface region). Therewith, the receiving means and/or the adhesive means layer are configured without adhesive tape, such that no manual application of an adhesive tape to the receiving means has to be performed. The inner side of the adhesive means layer is thereby configured on the inner side, meaning in the direction of the wall, preferably contacting the wall, since the application of the adhesive means occurs preferably directly to the surface region of the wall. With an application (depositing on) of the receiving means prepared with adhesive means to the transport device therefore a contact of the receiving means with the surface of the transport device occurs, meaning particularly a contacting of the outer side of the adhesive means layer with the surface of the transport device. Therewith with a further transport of the film material by the transport device due to the adhesion at the adhesive means layer a winding of the film material occurs in a simple manner.

It is further possible that the receiving means is configured as a sleeve, particularly for a winding unit configured as a winding roller or as a clamping head. Thereby the wall can comprise the bearing region at the inner side and the surface region at the outer side, wherein preferably the whole side area of the receiving means, particularly the surface region, comprises at least up to 40% or at least up to 70% or at least up to 90% or at least up to mainly 100% of the adhesive means layer. Preferably the surface region can be configured free from adhesive means only within the edge region. It can be provided that the surface region comprises an adhesive image which was applied by an application device of the winding machine. An application of the adhesive means to the receiving means on an area as large as possible or a complete area bears the advantage that a sufficient area for the adhesion at the film material is provided.

Likewise, a method for the performance of an automatized change of rollers for a winding machine with a transport device for the transport of film material is a subject matter of the invention. The method according to the invention comprises particularly at least one of the following steps which are preferably performed one after the other or in arbitrary order, wherein particularly preferably step B can be performed previous to step A or vice versa:

A. Arrangement of at least one receiving means at a winding unit, particularly within the winding machine, B. Automatized preparation of the receiving means with an adhesive means, particularly a melt adhesive, by at least one application device, preferably for the configuration of an adhesive means layer, preferably within the winding machine, C. Application of the receiving means prepared with the adhesive means to the transport device in order to enable an acceptance of the film material from the receiving means.

Therewith the method according to the invention provides the same advantages like they are described in detail in relation to the receiving means according to the invention. Further, a receiving means according to the invention can be used for the method according to the invention.

The method according to the invention thereby enables particularly an automatized change of rollers with a turning-free winding and/or a straight edge cut, particularly with an automatized preparation of the receiving means, particularly a sleeve. Preparation thereby particularly means the (automatized) application of the adhesive means, particularly a sprayable adhesive to the outer surface of the receiving means. The preparation thereby occurs preferably by an application device which is arranged within the winding machine. The prepared receiving means is particularly free from adhesive tape such that the effort for the manual application of the adhesive tape is diminished during the change of rollers. This further enables a preferably direct application of the receiving means prepared with adhesive means to the transport device without a contamination of the transport device by detached parts or structure of the surface area of the receiving means. After the application according to step C a particularly envelope-free acceptance of the film material by the receiving means can be enabled, particularly of the film tape. Therefore, preferably a beginning of the film is transported in the nip (receiving position or contact position of the transport device with the prepared receiving means). As soon as the beginning of the film contacts the prepared receiving means the film material or the beginning of the film sticks to the adhesive means and is transported along with the receiving means. Hereby, a winding or winding of the film material at the receiving means occurs. The method according to the invention particularly enables this winding without the need of a lifting of the film material from the transport device, particularly a contact roller. Here, an automatized preparation with the adhesive means can occur such that no expensive and elaborate adjustments of the used sleeve have to occur. The application of the receiving means prepared with adhesive means to the transport device occurs preferably film-free, meaning that no film is existent between the prepared receiving means and the transport device during application. Further, it is possible that for the method according to the invention a receiving is used with a sufficiently rigid wall and an adhesive means adjusted such that during application and/or after application to the transport device the structure of the surface region is mainly extensively preserved, meaning particularly that mainly none of the uppermost layers of the receiving means are detached, particularly the paper layers. This process has further the advantage that with steps B and C no manual intervention is necessary and therewith the change of rollers occurs particularly completely automatized.

Preferably within the scope of the invention it can be provided that with or after step C the film material is received from the receiving means, particularly a sleeve, particularly during the further transport to the transport device and/or is winded up mainly envelope-free. This is particularly enabled in that the prepared receiving means is applied directly to the surface of the transport device without film material being at the contact position. Hereby the quality of the film roller, meaning the receiving means with the already wound up film material is improved.

Optionally, it is possible that the application of the receiving means according to step C occurs directly to the transport device, particularly by contacting the transport device. Alternatively, it is possible that the receiving means contacts at least partially the film material, particularly the beginning of the film, during application. Therefore, the application has to be coordinated such that when the beginning of the film arrives in the nip the application occurs at the same time, meaning the contacting of the receiving means with the transport device and/or with the film material or the beginning of the film occurs at the same time. The application occurs therewith preferably during a contacting of the transport device and the beginning of the film or alternatively only during contacting of the transport device without contacting the film material at the same time. In order to reduce the effort for the complex coordination of the application according to step C a certain tolerance can be accepted such that an exclusive contacting of the receiving means with the film material occurs without contacting the transport device.

Further, it can be provided within the scope of the invention that the application of the receiving means to the transport device, particularly a contact roller, occurs mainly (meaning also completely) contactless to the film material according to step C. Thus, the area between the transport device and the receiving means is mainly free from film material during application. The contact roller is thereby preferably configured as a VSK-roller (vacuum-cutting-contact roller) in order to provide an improved cut for the generation of the (new) beginning of the film during the change of rollers.

Further, it can be provided within the scope of the invention that the application of the receiving means to the transport device according to step C can occur only by contacting the transport device and/or only by contacting at a contact area of the film material in which the film material abuts at the transport device. Particularly, during application according to step C the film material therewith abuts to the transport device and the application occurs only indirectly to the transport device and directly to the film material which is located between the transport device and the receiving means during application. Hereby, a contamination of the transport device by releasing parts of the receiving means is avoided.

It is further possible that the preparation of the receiving means occurs as a large scale, particularly full scale, application of the adhesive means, particularly such that a thin adhesive means layer covers at least largely or completely a surface region, particularly a side area of the receiving means. The largely preparation can preferably occur by an automatized spraying or wetting of the surface of the receiving means with the adhesive means. With a largely preparation thereby mainly the complete surface (side area or surface region) of the receiving means is provided with adhesive means. Hereby, a reliable receiving of the film material at the receiving means according to step C can occur.

According to a further advantage it can be provided that the adhesive means, particularly an adhesive means layer, comprises in average a thickness of maximum 2000 μm or maximum 1000 μm or maximum 700 μm or maximum 300 μm. Further, the average thickness can be, for example, in the area of 2 μm to 2000 μm and/or 5 μm to 300 μm and/or 100 μm to 200 μm. By the small thickness preferably a low stickiness is achieved in order to prevent a detaching of parts of the receiving means during application according to step C and therewith to prevent a contamination of the transport device. The average thickness is thereby determined at the receiving means, particularly by taking all thicknesses of the whole adhesive means layer into account.

Further, it is possible within the scope of the invention that according to step B for the preparation of the adhesive means occurs such that only a preparation region comprises an adhesive means layer and/or an edge region of the receiving means or the surface region is left out during application. Thereby, preferably a defined edge distance of each beginning and end of the receiving means, meaning particularly of the opposing lateral regions, can remain without adhesive means and/or can be left out during application. The preparation region thereby corresponds particularly with the area at which a winding with film material occurs. Thereby, the edge region can be configured as a defined edge region preferably in the lateral region of the receiving means (meaning for example in the area of the sleeve beginning and sleeve end) particularly preferred without adhesive means. Hereby, an optimal result during winding is ensured.

Further, it is possible within the scope of the invention that according to step B for the preparation an application of the adhesive means occurs as an adhesive image, particularly in a spiral form and/or circular. The adhesive image can thereby be configured as a combination of multiple forms (for example, partly circular or partly spiral-like) and/or comprise at least one edge region which is free from adhesive means. Thereby it is possible that the adhesive image is produced using a (particularly digital) template. Herefore the generation of the adhesive image can for example be controlled by a control device which, for example, controls an application device for the application of the adhesive image according to step B. This template can, for example, comprise the exact form of the adhesive image, for example, as a digital image and/or coordinate specification and/or parameter for the adhesive image like, for example, a respective inclination of the spiral. Therewith an optimal result during the winding of the film material can be achieved.

Further, it can be provided that according to step B for the preparation an application of the adhesive means occurs by an application head of the application device with a spray pressure of at least 0.2 bar or at least 0.4 bar or at least 0.8 bar or in an area of 0.1 bar to 1 bar, preferably 0.3 bar to 0.7 bar. Hereby, a reliable application of the adhesive means layer can be ensured with an optimal thickness.

It is further possible within the scope of the invention that according to step B for the preparation an application of the adhesive means, particularly a spraying, can occur such that air is supplied to the adhesive means wherein preferably the temperature of the adhesive means and/or the air in an application head of the application device mounts to between 150° C. to 300° C., preferably 160° C. to 220° C. Therewith the adhesive means particularly a melt adhesive, preferably a hot-melt adhesive, can be applied in a heated state to the adhesive area, meaning to a surface region of the receiving means according to step B. The adhesive means can be existent, for example, as a granulate or powder or film or rods or in block shape in the none-heated state previous to the application, wherein by the application device a heating of the adhesive means occurs directly previous to the application. Thereby, a heating to, for example, a temperature in the area of 150° C. to 200° C., preferably mainly 160° C. occurs. The adhesive means, for example, comprises polymer (like polyamides, polyethylenes and/or polyester) and possibly a resin and/or a stabilizer and/or wax. By heating a melting of the adhesive means occurs which is mixed with hot air, for example, in the application head of the application device (for example, with a temperature of the air in the area of 180° C. to 220° C.) for spraying. Therewith an even spraying of the adhesive means can occur for the configuration of the adhesive means layer on the receiving means according to step B.

Advantageously within the scope of the invention it can be provided that according to step B a rotation of the receiving means occurs by the winding unit, particularly a winding roller, particularly with the simultaneous movement of the application device or vice versa. The receiving means is for example configured cylinder-like such that for preparation the whole surface is reachable for the application device. Therefore, for example, the receiving means can be turned during the preparation about an axis of rotation while, for example, at the same time a movement of the application head occurs along the axis of rotation. Alternatively or additionally it is possible that the application device of the application head is displaceable along the axis of rotation and/or is configured rotatable about the receiving means. For the movement for example a drive unit can be provided which moves the application device or the application means which is moveably mounted in a guidance.

It is further possible that during the application of the prepared receiving means to the transport device according to step C the film material contacts the surface of the transport device, particularly completely and/or at least in the area of the beginning of the film, wherein particularly the application of the receiving means occurs free of detaching for the receiving means. The term free of detaching relates in this relation to the widely maintaining structure of a surface region of the receiving means during the application. The film path in the area of the beginning of the film hereby does not need to be lifted particularly from the surface of the transport device in order to apply the prepared receiving means to the transport device for winding. This has the advantage that an envelope-free winding can occur. Further, the advantage results that the film layers of the finished wrap are not unintentionally glued.

According to a further advantage it is possible that a first receiving means is arranged at a first winding unit for the acceptance of the film material wherein the first receiving means is prepared with adhesive means according to step B and a second receiving means is arranged at a second winding unit with the already wound up film material wherein a change of rollers occurs such that before or during or after step C the film material is separated at the separation site of the film material wherein the film material remaining at the transport device configures a beginning of the film at the separation site and preferably the beginning of the film is transported to the contact position of the first receiving means by the transport device subsequently and/or after the application of the first receiving means according to step C in order to effect a winding up of the film material at the first receiving means. The winding up is particularly effected in that the first receiving means is prepared with adhesive means which effects a sticking of the beginning of the film at the receiving means. Particularly by a rotation of the first receiving means subsequently a winding up of the film material at the first receiving means can occur. The first receiving means is preferably a receiving means according to steps A to C while the second receiving means can be processed in the same manner according to steps A to C or can be configured independently from this. The first receiving means is therewith particularly a new receiving means which is free from film material and the second receiving means is an already completely wound up film roller. The separation site is preferably arranged at the transport device and/or between the transport device and the second receiving means. Due to the separation of the film material, which is particularly performed by a cutting device, the film material is preferably separated in two parts. The first part thereby remains at the second receiving means and the second part remains at the transport device together with the beginning of the film. The beginning of the film is thereby the area which at first achieves the contact region during the further transport of the film material at the transport device and therewith contacts the first receiving means. Therewith, a faster and more reliable change of rollers can be performed.

Further, it can be provided that a further, particularly second, receiving means is provided which comprises wound up film material which is uniform in material and/or from one piece and/or monolithically connected with the film material at the transport device wherein for a change of rollers, particularly during or before step C, a separation of the film material at the transport device occurs in order to clear a connection. The separation preferably occurs by a cutting device which is arranged in the area of a transport device. Therewith, the change of rollers can occur automatized with little effort.

It can be further provided that the acceptance of the film material from the receiving means occurs such that the acceptance and/or the winding up and/or the winding of the film material is performable either clockwise or counter clockwise wherein particularly a reversal of rotation is enabled. Therewith, an automatized change of rollers can be performed in both directions of rotation wherein during the winding up the transport device can be rotatable clockwise and also counter clockwise about the axis of rotation. An acceptance of the film material meaning a contacting of the beginning of the film with the receiving means (particularly with the first receiving means) can therewith particularly occur from two different sides.

It can be further enabled that a separation of the film material for the change of rollers occurs edge straight by a cutting device, particularly by a cutting knife and/or inclined, particularly by a scraper blade. Therefore, the cutting device can preferably be arranged at and/or underneath the transport device. The transport device is preferably configured as a contact roller, preferably a VSK-roller, and therewith enables particularly an edge straight cut.

It can be further provided that a cutting device is provided with a scraper blade which is arranged particularly outside the transport device. The scraper blade and/or the cutting device is arranged or rested preferably outside the transport device at a frame of the transport device or at the device according to the invention. The transport device preferably comprises a groove which is configured particularly helical or spiralized. The scraper blade can be moveable at or in this groove for the separation of the film material, particularly axial to the transport device (particularly parallel to the axis of rotation of the transport device). Since the scraper blade draws axially for separation the groove at the transport device, particularly a contact roller, is preferably configured at least partially helical or spiralized and/or proceeds unevenly at the transport device surface. The scraper blade can for example retract into the groove, particularly synchronized to the rotation- or path speed, during the rotation of the transport device for separation wherein the groove is preferably incorporated into the transport device.

Further, it can be provided that according to step A at least two receiving means are arranged at one single winding unit wherein particularly a sensor device is provided and the sensor device detects a distance to the adjacent receiving means and/or the distance between the preparation regions of the receiving means during or previous to step B in order to particularly exclude the detected distance from an application with adhesive means according to step B. The at least two or three or four receiving means are therewith arranged next to one another, for example, along an axis of rotation of the winding unit wherein preferably a defined distance between the neighbouring receiving means is provided. Hereby, at the same time multiple receiving winders can be wound up to a single winding unit and/or prepared with adhesive means. Since the distance or the gap between the receiving means should not be prepared with adhesive means since here no receiving means is intended, particularly this distance is recognized by a sensor or sensor elements of the sensor device and accordingly the gap is not prepared or sprayed with adhesive means. Further, it is enabled that a preparation area is recognized by the sensor elements of the sensor device wherein only the preparation region is prepared with adhesive means and, for example, an edge region of the receiving means is excluded from adhesive means which, for example, can also comprise a distance between the receiving means. The sensor device can further additionally comprise sensor elements for the recognition of further parameters like a diameter of the receiving means with the film material in order to, for example, recognize if the desired film length is wound up to the receiving winder and possibly trigger an automatized change of rollers in the continuous process. The automatized change of rollers thereby comprises, for example, the separation of the film material transverse to the running direction particularly by a cutting device and initializes the initial winding up to a new (first) receiving means according to the steps A to C.

It is further enabled that by a control device and/or drive unit a positioning of the receiving means is controlled relative to the application device or vice versa, particularly in dependence from the detection of the sensor device, preferably coordinated to further process parameters, particularly a rotation speed of the winding unit and/or a moving speed of the application device. Thereby it can be enabled that the control device controls the process parameter coordinated to at least one of the following process parameters or at least partially directly: Positive and/or negative pressure generation at the transport device, positioning of the receiving means, positioning of the application device, rotation speed of the transport device, rotation speed of the winding unit, position of the beginning of the film. For example, a first control device for the drive unit and/or a second control device for the winding unit and/or a third control device for the transport device or further process parameters can be provided. Therewith an optimal coordination of the automatized change of rollers can be ensured.

Further, a device for the performance for the automatized change of rollers is protected. The device according to the invention preferably comprises:

at least one winding unit for the acceptance for at least one receiving means, at least one application device for the automatized preparation of the receiving means with an adhesive means, particularly a melt adhesive, a transport device for the transport of film material wherein receiving means prepared with the adhesive means are applicable to the transport device such that a receiving of the film material from the receiving means is performable.

Therewith, the device according to the invention provides the same advantages like they are described in detail in relation to the method according to the invention and the receiving means according to the invention. Further, the device according to the invention can be operated according to a method according to the invention. Further, for the device according to the invention a receiving means according to the invention can be used. A device according to the invention is preferably a winding machine, particularly for casting film and/or blow film. The device according to the invention is thereby preferably suitable for winding up continuous material.

Further, it can be provided within the scope of the invention that the application device comprises an application head arranged in the area of the winding unit, particularly a spray head, particularly for the large scale spraying of a surface region of the receiving means wherein particularly the application device is configured displaceably mainly parallel to an axis of rotation of the receiving means. Thereby, it is enabled that a control device is provided which automatically moves and/or displaces the application head and/or further parts of the application device, particularly in dependence of measured values of a sensor device. Hereby, an optimal automatization of the change of rollers is enabled.

According to an advantage within the scope of the invention it can be provided that the application device and/or the winding unit is arranged at a mechanic drive unit in order to adjust the distance between the application device and the winding unit and/or the receiving means by a positioning wherein preferably the drive unit is provided at, at least one lateral area of the winding unit. The winding unit is preferably configured as a winding shaft such that the winding unit is possibly mounted in rotary bearings at the drive unit and/or is configured rotatable by the drive unit. Alternatively or additionally a support device can be provided which receives the application device and/or the winding unit. Thereby, a detachable or non-detachable (fixed) arrangement of the application device and/or the winding unit at the support device and/or the drive unit and/or the device according to the invention is enabled. This enables a reliable automatized change of rollers.

It can be further provided within the scope of the invention that the distance between the application device and the receiving means for preparing the receiving means with the adhesive means is between 10 mm and 20 mm, preferably between 13 mm and 17 mm. Therewith a defined application of the adhesive means can occur to the surface region of the application means, particularly also an adhesive image.

Further, within the scope of the invention it can be provided that at least a conductive element, particularly an adhesive means and/or air-conductive element, particularly a heating tube, can be connected with the application device wherein the conductive element is configured particularly heat-resistant and/or flexible in order to conduct the adhesive means and/or the heated air to the application head. Further, preferably a separate air guiding conductive element can be connected with the application device. In this manner a reliable transport of the heated adhesive means and/or the heated air is performable within the application device to the application head. The conductive elements are, for example, configured as a tube and/or enable a movement of the application head relative to the transport device due to their flexibility.

Preferably, it can be provided that the conductive element is heat-resistant to at least 300° C., preferably to at least 200° C. and/or mainly to at least 160° C. and particularly configured as a plastic tube. Hereby, a reliable application of the adhesive means to the receiving means is enabled.

Optionally, it can be provided that the application device is displaceably arranged at a guidance which extends at least along the winding unit in order to enable a particularly complete application of the adhesive means to the receiving means. Therewith, it is enabled that the guidance extends along at least the whole length of the winding unit, for example, in the direction of the axis of rotation of the winding unit. The guidance can, for example, be connected with the drive unit and/or with the support device of the device according to the invention. Hereby, reliably a large area adhesive means layer can be generated on the receiving means.

Further, it can be provided that the application device comprises at least a sensor device with at least one sensor element wherein the sensor element is adjusted to the winding unit and particularly configured as a distance sensor in order to perform and/or detect and/or recognize and/or control a positioning at the receiving means. Further, the sensor element can for example be configured as a light sensor for the distance measurement. Herefore, the sensor element can, for example, comprise a sending and/or receiving element in order to, for example, detect reflected light. The sensor element can, for example, be for configured such that a distance between the receiving means arranged adjacent to the winding unit is detected (meaning a gap or distance between the receiving means). Hereby, an optimal automatization can occur.

It is further possible that the transport device comprises a none-adhesive coating in order to mainly retain particularly the structure of a surface region of the receiving means applied to the transport device. Therewith, it can be ensured that the adhesive means applied to the receiving means is not released from the surface region and therewith remains adhere to the transport device.

It can be further provided that the transport device comprises at least one opening for the generation of positive- and/or negative pressure which is arrangeable underneath the film material with applied film material such that a suctioning and/or repelling of the film material from the transport device is performable. The openings can thereby, for example, be fluidically connected with a fluidic machine particularly within the transport device for the generation of positive- and/or negative pressure. During the transport of film material to the transport device it is often necessary that the film material is sucked, for example, during a cutting process by the cutting device and is, for example, repelled during a winding in order to support the automatized change of rollers. The control of the fluidic machine can thereby, for example, occur automatized by, for example, a control device. The control device can thereby, for example, be connected with a sensor device which can metrologically record the status of the device according to the invention, meaning, for example, the speed of rotation and/or the position of the beginning of the film.

Further, it can be provided that a cutting device for the separation of the film material is provided and particularly the transport device comprises a gap which extends particularly along the axis of rotation of the transport device wherein preferably the cutting device is extendable for the separation through the gap. The cutting device and/or the gap comprises thereby an extension which, for example, mainly amounts to the width of the film material on the transport device and/or, for example, at least 70% or 80% of the width of the transport device. Thereby, it can be enabled that in the normal state the cutting device is completely retracted into the transport device and only extends during the performance of a change of rollers for the separation of the film material. The process of the separation can, for example, be controlled by a control device and monitored by a sensor device.

It can be further provided that at least a positioning sensor is provided directly adjacent in the area of the transport device and the receiving means in order to detect the position of the receiving means at the transport device. The positioning sensor can, for example, be configured as a distance sensor and comprise further sensors like, for example, cameras or suchlike. Possibly, a first or second drive unit can be provided in order to move the winding element between the application device and the transport device. In such a way the change of rollers can be coordinated by the control device.

It is further enabled that a positioning sensor and/or a sensor device with a control device is directly or indirectly electrically and/or wirelessly connected with a control device for positioning of the receiving means at the transport device, particularly for the application of the transport device, in order to particularly effect the application mainly to the point of time in which the beginning of the film of the film material contacts the receiving means at the transport device during application. In this way it is prevented that a contamination of the transport device occurs and further possibly an envelope-free winding is enabled. Since preferably only the beginning of the film of the film material contacts the receiving means and the beginning of the film particularly comprises the whole separation area of the film material at a separation position which arises during the cutting process by the cutting device, therewith particularly no protrusion of the film material at the receiving means exists which would prevent an envelope-free winding. Thus, the film material is only abutting at the transport device on one side of the receiving means during application and/or contacting of the receiving means at the transport device and/or the film material.

Further, it can be provided that a sensor device and/or a positioning sensor is directly or indirectly electrically and/or wirelessly connected to the application device in order to perform the automatized preparation in dependence from the position of the receiving means at the transport device. The automatized preparation is thereby particularly performed according to step B of the method according to the invention. Hereby, a reliable automatization of the change of rollers is enabled.

Likewise, subject matter of the invention is a film production device, particularly for the production of cast- or blow films, which preferably is configured as a blow film unit or a cast film unit. The film production device according to the invention is thereby particularly suitable to be operated with a method according to the invention or a device according to the invention or a receiving means according to the invention. Thereby, for example, an integration of the device according to the invention into the film production device according to the invention is enabled. The film and/or the film material can thereby, for example, comprise multiple layers and, for example, be transported as a continuous material from a transport device. The film production device according to the invention thereby provides the same advantages like they are described in detail in relation to the device according to the invention and/or a method according to the invention and/or a receiving means according to the invention.

Figure 3:
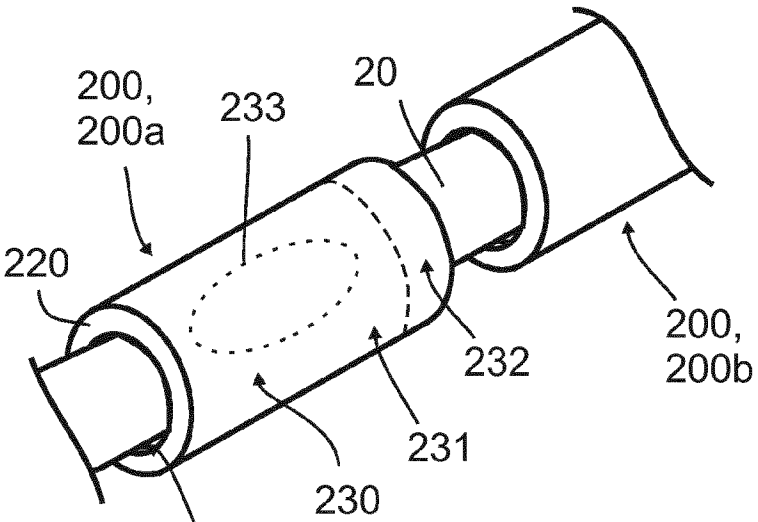
Figure 1:
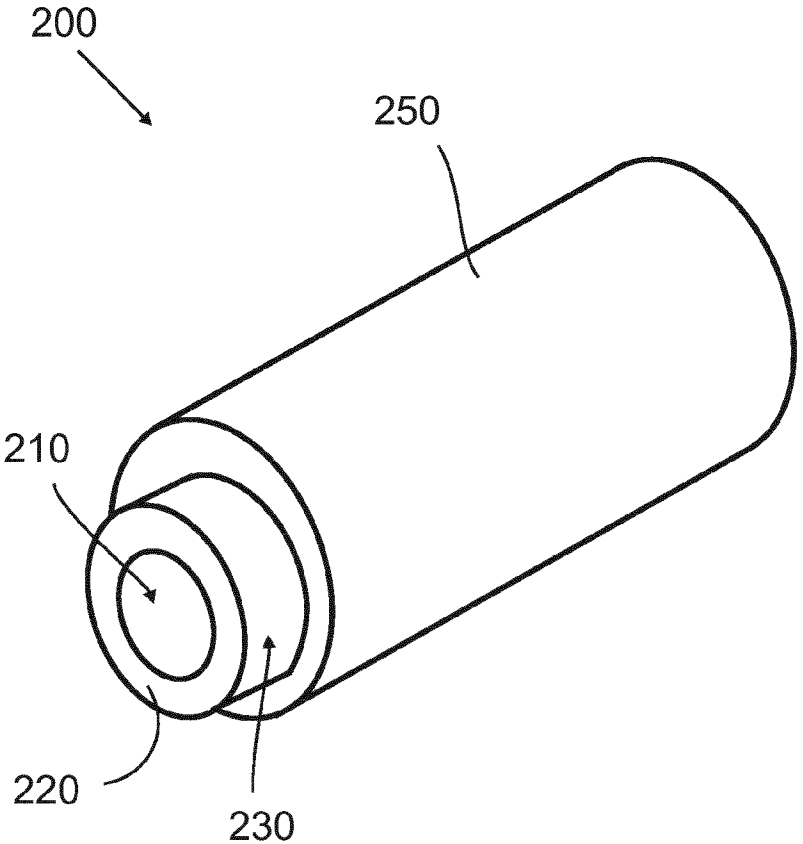
Figure 4:
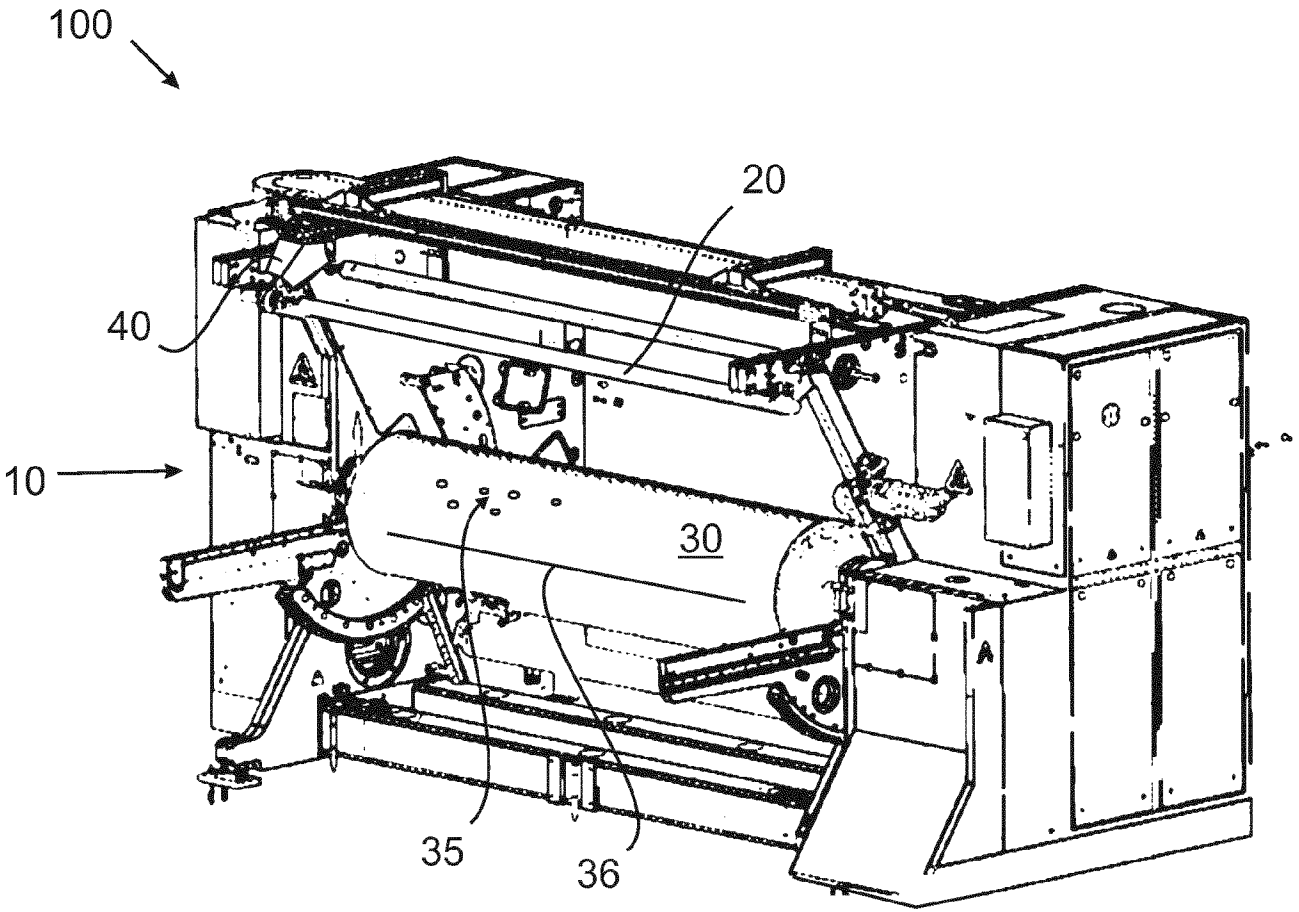
Figure 6:
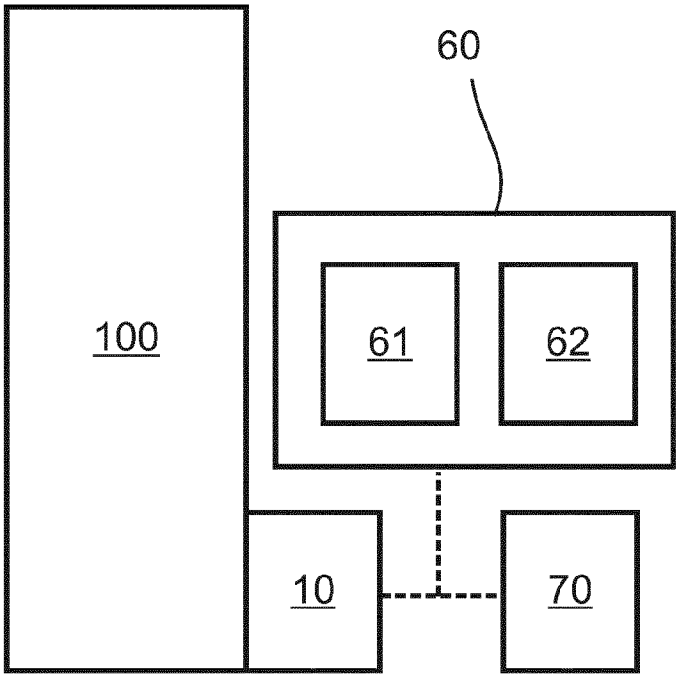
Figure 5:
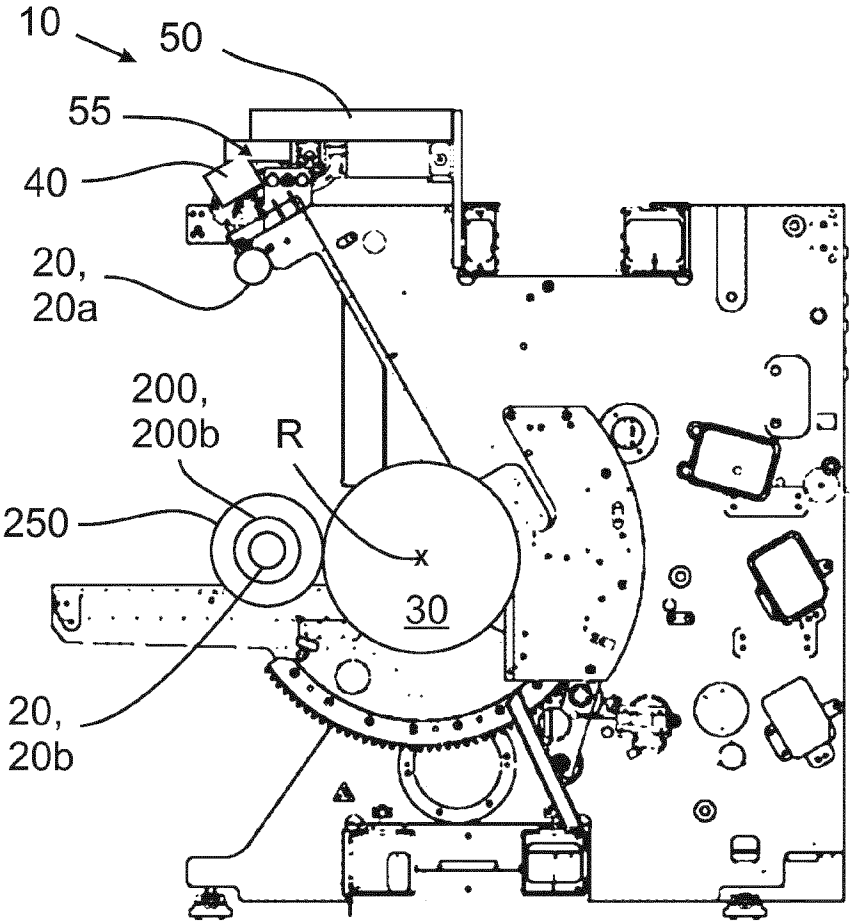
Figure 7:
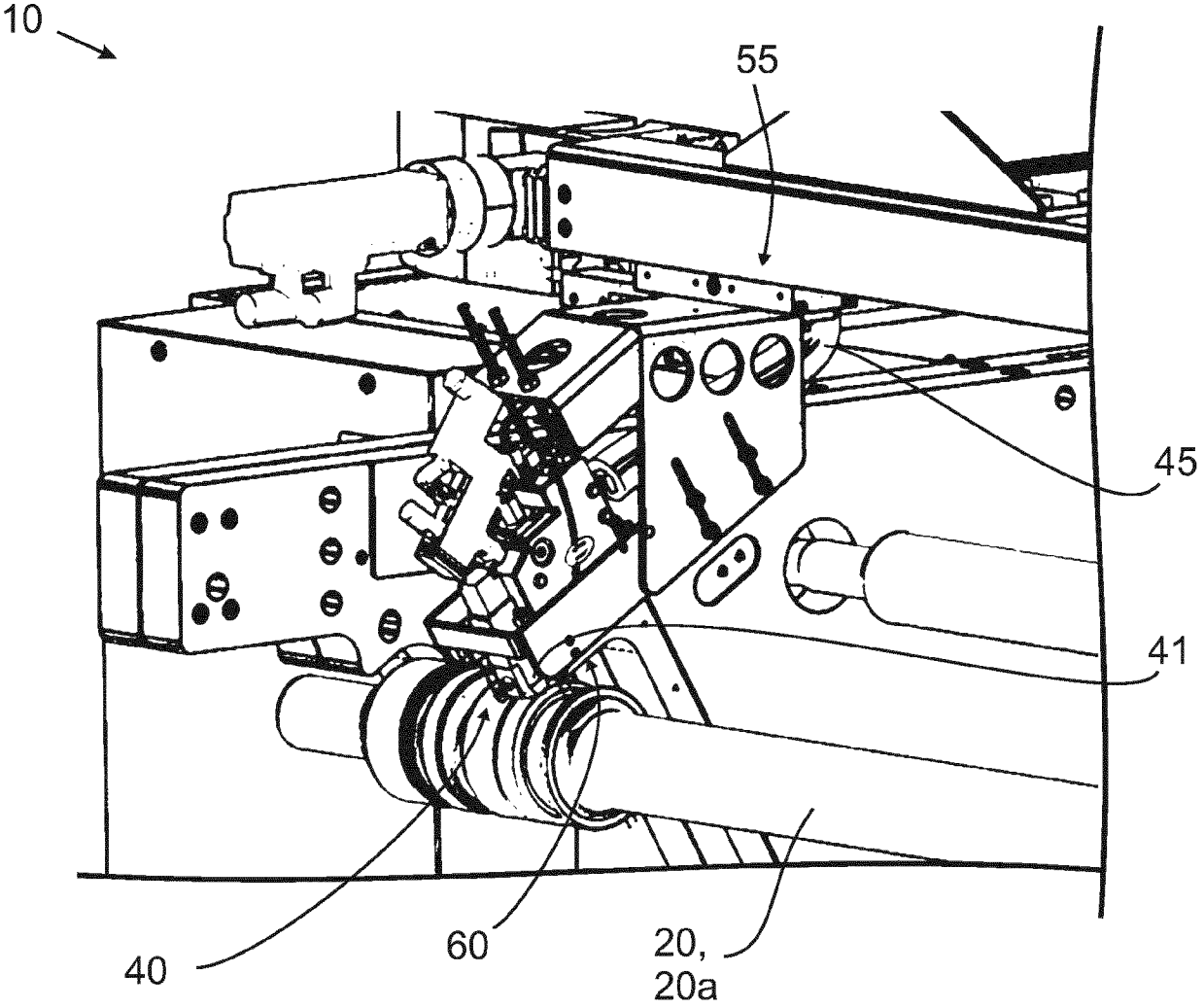

Further advantages, features and details of the invention result from the subsequent description in which embodiments of the invention are described in detail in relation to the drawings. Thereby the features described in the claims and in the description can be essential for the invention each single for themselves or in any combination. It is shown schematically:

FIG. 1 a perspective view of a receiving means according to the invention,

FIG. 2 an enlarged view of an adhesive means layer on a wall of the receiving means according to the invention, FIG. 3 a perspective view of two receiving means arranged next to each other on the winding unit, FIG. 4 a perspective view of a device according to the invention particularly as part of a film production device according to the invention, FIG. 5 a lateral view of a device according to the invention, FIG. 6 an arrangement of a device according to the invention, FIG. 7 an enlarged view of parts of a device according to the invention, FIGS. 8 to 14 lateral views on a device according to the invention for the visualization of a method according to the invention, FIG. 15 visualization of method steps of a method according to the invention.

In the subsequent figures for the same technical features even of different embodiments the identic reference signs are used.

In FIG. 1 a receiving means 200 according to the invention is shown schematically in a perspective view. A wall 220 can be recognized which is particularly configured as a hollow cylinder and comprises an inner side and an outer side. The inner side configures a bearing region 210 for the arrangement of the receiving means 200 at the winding unit 20 of a winding machine 10. The winding unit 20 is, for example, configured as a winding shaft and can particularly be inserted into the receiving means 200. The bearing area 210 therewith directly contacts to the winding unit 20 and enables, for example, a torque-proof and/or immobile bearing of the receiving means 200 at the winding unit 20 in order to enable a rotation of the receiving means 200 during a rotation of the winding unit 20. Alternatively, a pivotable bearing of the receiving means 200 at the winding unit 20 can be provided. The outer area of the wall 220 comprises a surface region 230 of the receiving means 200. This receiving region 230 is suitable as an outer mantle surface of the receiving means 200 and thereby for the acceptance or for winding of film material 250. In FIG. 1 thereby the wound up film material 250 can be recognized which is, however, only accepted from a partial area of the surface region 230. This area, for example, corresponds to a preparation area 231 which is equipped with adhesive means 234. The free area of the surface region 230 which is not covered by film material 250 thereby corresponds, for example, to an edge area 232.

FIG. 2 shows an enlarged sectional view through an outer adhesive means layer 235 with an adhesive means 234 which is configured on a surface region 230 of the wall 220 of the receiving means 200. Therewith, further an average thickness D of the adhesive means layer 235 is characterized. The greatest thickness of the adhesive means layer 235 and the smallest thickness of the adhesive means layer 235 can thereby, for example, differ maximum about 50% or about maximum 30% or about maximum 10% of the average thickness D.

FIG. 3 shows a schematic perspective view of two receiving means 200 wherein a first receiving means **200*a* is adjacently arranged together with a second receiving means 200*b* at the winding unit 20. Both receiving means 200 according to the invention are thereby movably or immovably mounted at the winding unit 20 in a bearing region 210. Preferably, thereby the winding unit 20 is pivotably mounted in order to effect a rotation of the receiving means 200 non-rotatably connected with the winding unit 20. The two receiving means 200 according to the invention are thereby arranged at the common winding unit 20 wherein between the first receiving means 200*a* and the second receiving means 200*b* a distance or a gap can be recognized. This gap is possibly excluded from the automatized preparation of the receiving means 200 with an adhesive means 234. Likewise, it is enabled that an edge area 232 is excluded from the preparation and therewith is configured free from adhesive means after the preparation. Therewith an application of the adhesive means 234 during the automatized preparation occurs preferably only in a preparation area 231 of the receiving means 200 or the receiving means 200 or only in a defined area according to an adhesive image 233**.

In FIG. 4 schematically a device 10 according to the invention is shown which, for example is part of a film production device 100 according to the invention, particularly for the production of cast- or blow film. The device 10 according to the invention at least comprises a winding unit 20 for the acceptance of at least one receiving means 200 and at least one application device 40 for the automatized preparation of the receiving means 200 with an adhesive means 234. Further, the device 10 according to the invention comprises a transport device 30 which is, for example, configured as a contact roller 30 and configured for the transport of film material 250. The transport device 30 can, for example, be configured as a VSK-roller and, for example, comprise multiple openings 35 which serve for the generation of a negative pressure or a positive pressure. Further, a gap 36 can be provided along an axis of rotation R through which a cutting device 37 is extendable.

In FIG. 5 a lateral view of a device 10 according to the invention is shown. Thereby, the transport device 30 can be recognized which is rotatably mounted about an axis of rotation R. Likewise, it can be recognized that film material 250 is wound to a receiving means 200 according to the invention, particularly a second receiving means **200*b* at a second winding unit 20*b*. Hereby, a film roller results which is exchanged with a new receiving means 200 upon reaching the desired film length by an automatized change of rollers, particularly a first receiving means 200*a*. The first receiving means 200*a* is hereby applied to a first winding roller 20*a* in order to be prepared with adhesive means 234. The application of the adhesive means 234 for the configuration of the adhesive means layer 250 thereby occurs by an application device 40 which is, for example, pivotably mounted in a guidance 55 and/or is moved, for example, along the axis of rotation R by a drive unit 50**.

FIG. 6 serves for the clarification of the construction of a device 10 according to the invention and the integration of the device 10 according to the invention into a film production device 100. The film production device 100 can thereby, for example, be configured as a cast- and/or blow film unit wherein the produced films are transported to the device 10 according to the invention, particularly a winding machine 10, for the winding up to the receiving means 200 according to the invention. For the performance for an automatized change of rollers thereby a control device 70 of the device 10 is provided which, for example, for monitoring the change of rollers is connected to a sensor device 60 of the device 10 according to the invention. The sensor device 60 comprises, for example, a sensor element 61 and/or a positioning sensor 62.

In FIG. 7 an enlarged representation of parts of a device 10 according to the invention is shown, particularly an application device 40. Thereby, it can be recognized that the application device 40, particularly an application head 41 of the application device 40, is arranged spaced apart to the winding unit 20 and/or to the receiving means 200. For example, a displacement of the application head 41 is performable along the guidance 55 wherein a heated adhesive means 234 is transported through conductive elements 45 to the application head 41. In order to follow the movement the conductive element 41 is configured particularly flexible and/or as a tube. For monitoring the distance of the application head 41 from the winding 20 and/or from the receiving means 200 according to the invention, for example, a sensor device 60 is provided which preferably comprises at least one sensor element 61 or at least one distance sensor 61.

In FIGS. 8 to 14 a lateral view of parts of a device 10 according to the invention is shown wherein a transport device 30 is represented which is rotatably mounted about an axis of rotation R. Further, an additional roller 38, particularly a support roller 38, is provided at which film material 250 is guided for the transport device 30. The film material 250 is transported along the transport device 30 to a film roller which is configured by a second receiving means 200*b* at a second winding unit 20*b* and the wound up film material 250. Likewise, an application head 41 is shown for spraying the receiving means 200 according to the invention with an adhesive means 234. In the area of the application head 41 thereby a first receiving means 200*a* is arranged at a first winding unit 20*a*.

Figure 8:
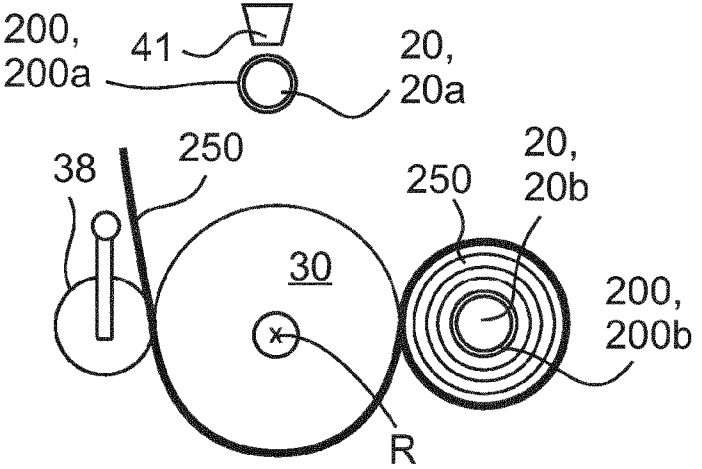
Figure 9:
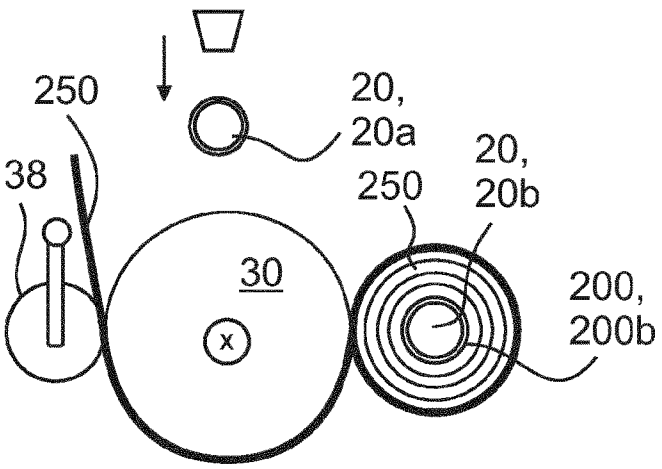
Figure 10:
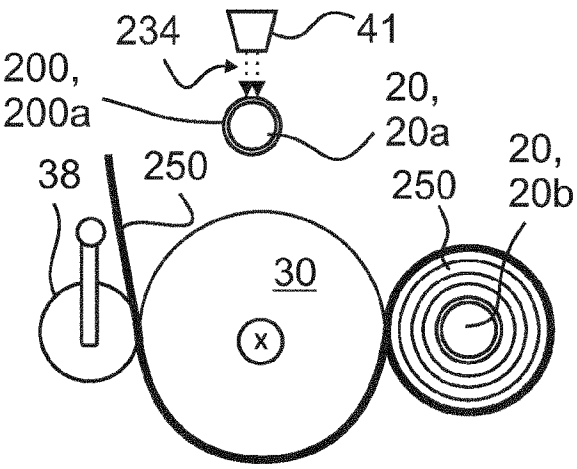
Figure 11:
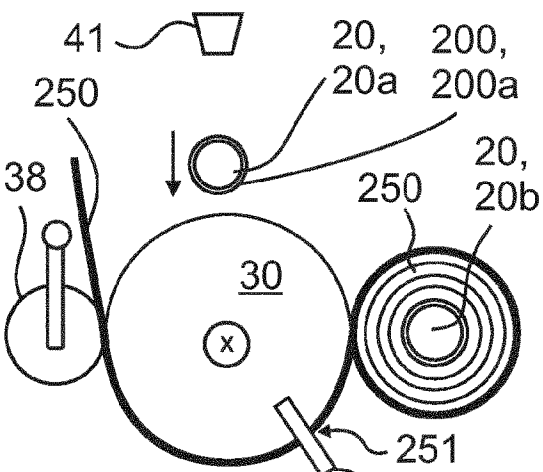

According to FIG. 8 initially a basic position of the device 10 according to the invention is shown with which the winding to the second receiving means 200*b* occurs. When the desired film length is achieved a change of rollers is initialized according to FIG. 9 wherein the first receiving means 200*a* proceeds in the adhesive position with the first winding shaft 20*a*. According to FIG. 10 subsequently the automatized preparation of the first receiving means 200*a* occurs with the adhesive means 234 in order to configure an adhesive means layer 235 on the first receiving means 200*a*. During the application of the adhesive means 234 thereby particularly the first winding unit 20*a* rotates together with the first receiving means 200*a*. Subsequently to the application of adhesive means 234 in the desired area the first winding unit 20*a* is transported to a waiting position with the first receiving means 200*a* according to FIG. 11 and moreover a cut through the film path occurs by a cutting device 37. Thereby, the cutting device 37 cuts at a separation site 251 at which now a beginning of the film 251 results at the film material 250 remaining at the transport device 30.

According to FIG. 12 now the application of the receiving means 200*a* prepared with adhesive means 234 to the transport device 30 occurs in order to enable an acceptance of the film material 250 from the receiving means 200. Thereby, the beginning of the film 251 of the film material 250 at the transport device 30 is transported into the direction of the first receiving means 200*a*. The application of the first receiving means 200*a* or the receiving means 200 and the herefore necessary movement of the winding unit 20 or the first winding unit 20*a* is, for example, coordinated or controlled by a control device 70 possibly by using a sensor device 60.

According to FIG. 13 the complete film roller, meaning the second winding unit 20*b*, is lifted from the transport device 30 with the second receiving means 200*b* and the winding of the first receiving means 200*a* occurs. According to FIG. 14 now the new, first winding unit 20*a* in transferred into a basic position with the new, first receiving means 200*a*, meaning into the position which previously was taken by the second winding unit 20*b*. Therewith, the automatized change of rollers is completed.

In FIG. 15 method steps of a method 300 according to the invention are shown schematically. Thereby, according to a first method step 301 an automatized preparation of the receiving means 200 with an adhesive means 234 occurs. According to a second method step 302 an application of the receiving means 200 prepared with the adhesive means 234 to the transport device 30 occurs in order to enable an acceptance of the film material 250 from the receiving means 200.

The previous description of the embodiments describes the present invention only within the scope of examples. Naturally, single features of the embodiment, as far as technically meaningful, can be freely combined with one another without leaving the scope of the invention.

REFERENCE LIST

10 device, winding machine
20 winding unit
20*a* first winding unit
20*b* second winding unit
30 transport device
35 openings
36 gap
37 cutting device
38 support roller
40 application device
41 application head, spray head
45 conductive element
50 drive unit
55 guidance
60 sensor device
61 sensor element, distance sensors
62 positioning sensor
70 control device
100 film production device
200 receiving means
200*a* first receiving means
200*b* second receiving means
210 bearing region
220 wall
230 surface region, mantle surface
231 preparation area
232 edge region
233 adhesive pattern
234 adhesive means
235 adhesive means layer
250 film material
251 separation site, beginning of the film
300 method
301 first method step
302 second method step D thickness of the adhesive means layer
R axis of rotation

The invention claimed is:

1. Receiving means for receiving film material for the use in a winding machine, wherein:

the receiving means has at least one bearing region for mounting the receiving means to the winding unit of the winding machine, a wall with an outer surface region, and an outer adhesive means layer at least partially covering the outer surface region of the wall, wherein the outer surface region of the wall is placeable on a winding machine and the film material is receivable on the outer surface region;

wherein the outer adhesive means layer is configured to contact the film material, wherein the outer adhesive means layer has an average thickness of at least 100 μm and at most 700 μm to maintain the structure of the outer surface region at least during or after the placement on the transport device as far as possible, wherein the outer adhesive means layer is configured without adhesive tape.

2. Receiving means according to claim 1, wherein the average thickness of the adhesive means layer is at most 100 μm or 700 μm or 300 μm.

3. Receiving means according to claim 1, wherein the receiving means is configured as a sleeve, wherein the wall has a bearing region on the inner side and a surface region on the outer side, comprises to at least 40% or 70% or 90% of a surface area of an adhesive means layer.

4. Method for the implementation of an automated change of a roller for a winding machine with a transport device for transporting film material, comprising the following steps, which are performed in any order:

A. Mounting of at least one receiving means at a winding unit,

B. Automatized preparation of the receiving means with an adhesive means, by at least one application device, wherein the prepared receiving means is particularly free from adhesive tape, wherein the adhesive means has an average thickness of at least 100 μm and at most 700 μm, C. Application of the prepared receiving means prepared with the adhesive means to the transport device such that the prepared receiving means is in direct contact with the transport device in order to enable an acceptance of the film material from the prepared receiving means.

5. Method according to claim 4, wherein during or after step C, the film material, is winded up mainly without flipping over by the prepared receiving means.

6. Method according to claim 4, wherein the application of the prepared receiving means according to step C occurs directly to the transport device.

7. Method according to claim 4, wherein the application of the prepared receiving means to the transport device, occurs according to step C mainly contactless to the film material.

8. Method according to claim 4, wherein the application of the prepared receiving means to the transport device according to step C occurs only by contacting a contact region of the film material in which the film material abuts to the transport device.

9. Method according to claim 4, wherein the preparation of the prepared receiving means occurs as a large, application of the adhesive means, of the prepared receiving means.

10. Method according to claim 4, wherein according to step B for preparing an application of the adhesive means occurs in that only a preparation area comprises at least an adhesive layer or an edge region is left out during application.

11. Method according to claim 4, wherein according to step B for preparing an application of the adhesive means as an adhesive pattern occurs.

12. Method according to claim 4, wherein according to step B for preparing an application of the adhesive means by an application head of the application device occurs with a spraying pressure of at least 0,2 bar or at least 0,4 bar or at least 0,8 bar.

13. Method according to claim 4, wherein according to step B for preparing an application of the adhesive means occurs such that air is provided to the adhesive means.

14. Method according to claim 4, wherein with step B a rotation of the receiving means by the winding unit occurs.

15. Method according to claim 4, wherein during the application of the prepared receiving means to the transport device according to step C, the film material contacts the surface of the transport device.

16. Method according to claim 4, wherein a first receiving means is mounted to a first winding unit for the acceptance of the film material, wherein the first receiving means is prepared with an adhesive means according to step B and a second receiving means is mounted to an already wound up film material at a second winding unit, wherein a roller exchange occurs such that before, during or after step C the film material is separated at a separation sight of the film material, wherein the film material remaining at the transport device comprises a film beginning at the separation site the film beginning is transported to the contact site of the first receiving means with the transport device in order to effect an initial winding of the film material to the first receiving means.

17. Method according to claim 4, wherein a further, receiving means is provided which comprises wound up film material which is connected uniform in material with the film material at the transport device, wherein for the exchange of rollers, a separation of the film material at the transport device occurs in order to clear the connection.

18. Method according to claim 4, wherein a separation of the film material for the exchange of rollers occurs via a cutting device edge at least straight, or inclined.

19. Method according to claim 4, wherein according to step A at least two receiving means are mounted to a single winding unit.

20. Method according to claim 4, wherein by at least a control device or a drive unit a positioning of the receiving means is controlled relative to the application device or vice versa.

21. Method according to claim 4, wherein the prepared receiving means is configured to receive film material for the use in a winding machine, wherein the prepared receiving means has at least one bearing region for mounting the prepared receiving means to the winding unit of the winding machine and a wall with an outer surface region, wherein a wall is configured such that the outer surface region is placeable on a winding machine and the film material is receivable on the surface region wherein that the outer surface region at least partially comprises an outer adhesive means layer for making contact with the film material, wherein the outer adhesive means layer has an average thickness of a maximum of 700 μm to maintain the structure of the surface region at least during or after the placement on the transport device as far as possible.

22. Device for the performance of an automatized change of rollers comprising:

at least one winding unit for the acceptance of at least one receiving means, at least one application device for automatized preparation of the receiving means with an adhesive means, wherein the prepared receiving means is particularly free from adhesive tape, wherein the adhesive means has an average thickness of at least 100 μm and at most 700 μm, a transport device for the transport of film material wherein the prepared receiving means prepared with an adhesive means is in direct contact with the transport device such that an acceptance of the film material is performable by the prepared receiving means.

23. Device according to claim 22, wherein the application device comprises an application head in the region of the winding unit.

24. Device according to claim 22, wherein at least the application device or the winding unit is attached to a mechanic drive unit in order to adjust a distance between the application device and at least the winding unit or the receiving means by a positioning.

25. Device according to claim 22, wherein the distance between the application device and the receiving means for preparing the receiving means with the adhesive means amounts to between 10 mm and 20 mm.

26. Device according to claim 22, wherein at least an adhesive means or air-conducting conductive element, is connected with the application device, wherein the conductive element is configured to conduct at least the adhesive means or the heated air to the application head.

27. Device according to claim 22, wherein the conductive element is heat-resistant until at least 300° C.

28. Device according to claim 22, wherein the application device is arranged displaceable at the guidance which extends at least along the winding unit in order to enable a, application of the adhesive means to the receiving means.

29. Device according to claim 22, wherein the application device comprises at least one sensor device with at least one sensor element, wherein the sensor element is adjusted to at least the winding unit or to the receiving means and is configured in order to at least perform or detect a positioning at the receiving means.

30. Device according to claim 22, wherein the transport device comprises a non-stick coating in order to mainly preserve the structure of the surface area of the receiving means applied to the transport device.

31. Device according to claim 22, wherein at least a positioning sensor is provided directly adjacent in the area of the transport device and the prepared receiving means in order to detect the position of the prepared receiving means at the transport device.

32. Device according to claim 22, wherein a positioning sensor is directly or indirectly electrically or wirelessly connected with a control device for positioning of the prepared receiving means at the transport device, in order to effect the application mainly to the point in time in which the beginning of the film of the film material contacts to the transport device during application of the prepared receiving means.

33. Device according to claim 22, wherein at least a sensor device or a positioning sensor is directly or indirectly electrically or wirelessly connected with the application device in order to perform the automatized preparation in dependence of the position of the receiving means at the transport device.

34. Device according to claim 22, wherein the device operable according to a method for the implementation of an automated change of a roller for a winding machine with the transport device for transporting film material, comprising the following steps, which are performed in any order:

A. Mounting of the at least one receiving means at the winding unit,

B. Automatized preparation of the receiving means with the adhesive means, by the least one application device, C. Application of the receiving means prepared with the adhesive means to the transport device in order to enable an acceptance of the film material from the receiving means.

35. Device according to claim 22, wherein the adhesive means has an average thickness of at most 700 μm.

36. Film production device, with a device for the performance of an automatized change of rollers comprising:

at least one winding unit for the acceptance of at least one receiving means, at least one application device for automatized preparation of the receiving means with an adhesive means, wherein the prepared receiving means is particularly free from adhesive tape, wherein the adhesive means has an average thickness of at least 100 μm and at most 700 μm, a transport device for the transport of film material wherein the prepared receiving means prepared with the adhesive means is in direct contact with the transport device such that an acceptance of the film material is performable by the prepared receiving means.

* * * * *